US007862249B2

(12) United States Patent
Ohashi et al.

(10) Patent No.: US 7,862,249 B2
(45) Date of Patent: Jan. 4, 2011

(54) BALL-POINT PEN TIP AND INK REFILL

(75) Inventors: Mitsuhiro Ohashi, Yokohama (JP); Atsushi Nakajima, Yokohama (JP); Kazuhiko Furukawa, Yokohama (JP); Hiroyuki Muto, Yokohama (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 0 days.

(21) Appl. No.: 12/310,618

(22) PCT Filed: Aug. 27, 2007

(86) PCT No.: PCT/JP2007/066558

§ 371 (c)(1),
(2), (4) Date: Jun. 21, 2010

(87) PCT Pub. No.: WO2008/026543

PCT Pub. Date: Mar. 6, 2008

(65) Prior Publication Data

US 2010/0254750 A1 Oct. 7, 2010

(30) Foreign Application Priority Data

Sep. 1, 2006 (JP) ..... 2006-238163

(51) Int. Cl.
*B43K 7/10* (2006.01)

(52) U.S. Cl. ..... 401/216; 401/209

(58) Field of Classification Search ..... 401/209, 401/211, 212, 214, 215, 216
See application file for complete search history.

(56) References Cited

U.S. PATENT DOCUMENTS 3,252,214 A * 5/1966 Fisher ..... 29/441.1
5,876,142 A * 3/1999 Furukawa ..... 401/209

(Continued)

FOREIGN PATENT DOCUMENTS

JP 10-329475 A 12/1998

(Continued)

*Primary Examiner*—David J Walczak
(74) *Attorney, Agent, or Firm*—Kubovcik & Kubovcik

(57) ABSTRACT

There is provided a ballpoint pen tip in which a shoulder of a bent portion does not touch a paper surface during writing and bleeding caused by deformation of an inner periphery of the bent portion can be prevented, and an ink refill using thereof. The ballpoint pen tip 20 comprises a first tapered surface 22 formed by tapering an outer periphery at a front end of a holder 21, a connecting surface 23 that is formed at a front end side of the first tapered surface 22 and has an outside angle larger than 180° with respect to the first tapered surface 22, a second tapered surface 24 that is formed at a front end side of the connecting surface 23 and has an outside angle smaller than 180° with respect to the connecting surface 23, and a bent portion 25 in which a front end portion of the second tapered surface 24 is bent inwardly so as to hold a writing ball 35 inserted into a ball house 29. A boundary between the first tapered surface 22 and the connecting surface 23 is referred to as a first shoulder portion 26, and a boundary between the second tapered surface 24 and the bent portion 25 a second shoulder portion 27. The second shoulder portion 27 is located inside a virtual tangent line 41 between the first shoulder portion 26 and the writing ball 35.

6 Claims, 7 Drawing Sheets

U.S. PATENT DOCUMENTS 6,082,920 A 7/2000 Furukawa ..... 401/216

FOREIGN PATENT DOCUMENTS

JP 3156988 B2 2/2001
JP 2002-200877 A 7/2002
JP 2003-276383 A 9/2003
JP 2003-320781 A 11/2003
WO 98/30401 7/1998

* cited by examiner

BALL-POINT PEN TIP AND INK REFILL

This application is a 371 of international application PCT/JP2007/066558, filed Aug. 27, 2007, which claims priority based on Japanese patent application No. 2006-238163, filed Sep. 1, 2006, which is incorporated herein by reference.

TECHNICAL FIELD

The present invention relates to a ballpoint pen tip used as a writing tip of a ballpoint pen, and to an ink refill to which the ballpoint pen tip is mounted.

BACKGROUND ART

An example of a ballpoint pen tip used as a writing tip of a ballpoint pen is formed by cutting a cylindrical metal material. In such a ballpoint pen tip, a writing ball is inserted into a ball house formed in its front end, and then its front edge is bent inwardly by press deformation to hold the writing ball.

Ink for a ballpoint pen includes oil-based ink and water-based ink. The water-based ink generally has a lower viscosity than that of the oil-based ink, and thus, if the writing tip is held downward, so-called "bleeding" may occur that is a phenomenon in which the ink is lowered by gravity and leaks from the writing tip. When the ballpoint pen is clipped to a breast pocket of clothes, the ink leaks by this phenomenon to dirt the clothes. Such a phenomenon particularly becomes a problem in a ballpoint pen such as a so-called retractable ballpoint pen in which a writing tip is always open without being covered with a cap and the writing tip is almost always kept downward both while being used and while not being used.

Thus, particularly in a retractable ballpoint pen using water-based ink, as in the techniques described in Patent Documents 1 and 2 below, a spring is mounted in a ballpoint pen tip, and a writing ball is always pressed toward a front end and biased to block a clearance between the writing ball and a bent portion, thereby preventing the bleeding. Moreover, as in the technique described in Patent Document 3 below, an elastic body is inserted instead of the spring to achieve the same advantage.

Further, a conventional technique including a three-step tapered portion in a writing tip is described in Patent Document 4 below.

Patent Document 1: JP 10-329475 A (FIGS. 1 to 3)

Patent Document 2: JP 2002-200877 A (FIG. 2)

Patent Document 3: JP 3156988 B (FIG. 1)

Patent Document 4: WO98/030401 (re-publication of Japanese Patent Application No. 10-530728)

DISCLOSURE OF THE INVENTION

In the ballpoint pen provided with such a bent portion as described above, a shoulder of the bent portion sometimes touches a paper surface to deform an inner periphery of the bent portion if a writing angle with respect to the writing surface is shallow. This also applies to the conventional technique described in Patent Document 4 above. If the deformation creates a gap between the bent portion and the ball, the bleeding is likely to occur while the writing tip is held downward. Further, there may occur a problem of poor quality of writing lines.

Thus, the present invention has an object to provide a ballpoint pen tip in which a shoulder of a bent portion does not touch a paper surface during use and bleeding caused by deformation of an inner periphery of the bent portion can be prevented, and an ink refill using the ballpoint pen tip.

To achieve the above-described object, the present invention provides a ballpoint pen tip comprising:

a holder;

a first tapered surface formed by tapering an outer periphery at a front end of the holder;

a connecting surface being a surface formed at a front end side of the first tapered surface, and making an outside angle larger than 180° with respect to the first tapered surface in a virtual section including an axis of the holder;

a second tapered surface being a tapered surface formed at a front end side of the connecting surface, and making an outside angle smaller than 180° with respect to the connecting surface in the virtual section;

a ball house formed as an inner space of the first tapered surface, the connecting surface, and the second tapered surface;

a back hole formed as an inner space extending from a rear end of the holder to a vicinity of the ball house;

an ink hole being a hole with a circular section penetrating between the ball house and the back hole;

channel grooves being a plurality of grooves provided at regular intervals around the ink hole so as to communicate between a bottom surface of the ball house and the ink hole;

a writing ball located in the ball house;

a ball seat formed in the bottom surface of the ball house by transferring a part of a curved surface of the writing ball; and a bent portion being formed by inwardly bending a front end portion of the second tapered surface;

wherein a boundary between the first tapered surface and the connecting surface is referred to as a first shoulder portion;

a boundary between the second tapered surface and the bent portion is referred to as a second shoulder portion; and the second shoulder portion is located inside a virtual tangent line between the first shoulder portion and the writing ball in the virtual section.

The "holder" is a main body of the ballpoint pen tip except the "writing ball" and is formed by, for example, cutting a cylindrical metal material such as stainless steel. Depending on the purpose of use, the holder may be formed by plastic deformation and cutting of a pipe material. The portion cut in a tapered manner at a front end side of the holder is referred to as "first tapered surface." It should be understood that the "front end" is the side of the writing tip of the ballpoint pen tip, and the side opposite therefrom is a "rear end." Although there is no limitation with respect to the rear end of the holder, the rear end may be cut so as to have a decreasing outer diameter to form a portion to be inserted into an "ink-containing tube" or into a joint provided between the holder and the ink-containing tube.

The "connecting surface" is a surface having a reduced diameter at a front end side of the first tapered surface and connecting between the first tapered surface and the second tapered surface. An outside angle formed between the first tapered surface and the connecting surface is larger than 180° in a virtual section including an axis of the holder. That is, it is assumed that there is a section including the axis of the holder (which is referred to as the "virtual section") in the ballpoint pen tip according to the present invention. Then, when angles formed between a line along the first tapered surface and a line along the connecting surface are measured in the virtual section, providing that the angle in a substantial portion of the holder is an "inside" angle, the other "outside" angle (i.e., the angle of a portion that is not the substantial portion of the holder) is larger than 180°.

Further, the boundary between the first tapered surface and the connecting surface, that is, a vertex of the "angle" described above, is referred to as the "first shoulder portion."

The "second tapered surface" is a tapered surface inclined to protrude from the connecting surface so that a front end side of the connecting surface is further tapered. Further, the "outside" angle formed between the connecting surface and the second tapered surface is smaller than 180° when similarly measured in the virtual section. It should be understood that the angle is within a range in which the second tapered surface is tapered, in other words, a range in which the second tapered surface does not diverge or is not parallel to the holder axis, though the angle is smaller than 180°.

The "ball house" is a space formed from the front end side in a portion corresponding to inner peripheries of the first tapered surface, the connecting surface, and the second tapered surface, and the writing ball is inserted therein. When the holder is formed of a cylindrical material, the ball house is formed by cutting from the front end. When the holder is formed of a pipe material, the ball house is formed by using an inner space to a press-deformed portion by punching from an outer periphery as it is or by cutting the inner space so as to slightly increase an inner diameter.

The "back hole" is a central hole extending from the rear end of the holder to a vicinity of the ball house. When the holder is formed of a cylindrical material, the back hole is formed by cutting, and when the holder is formed of a pipe material, an inner space from the rear end to the ball house is used as the back hole as it is. In the back hole, ink contained in an "ink-containing tube" is introduced to the ball house.

The "ink hole" is a central hole having a smaller diameter than the back hole and connecting between the back hole and the ball house.

The "channel grooves" are axial grooves provided at regular intervals around the ink hole. When the holder is formed of the cylindrical material, the channel grooves are formed from the bottom surface of the ball house by cutting with a channel tool. When the holder is formed of a pipe material, gaps between press-deformed portions by punching in forming the ball house are used as the channel grooves. The ink introduced to a front end of the back hole flows from the ink hole through the channel grooves to the ball house. The channel grooves are preferably formed to penetrate to the back hole in terms of ink flow when ink used has a relatively high viscosity and resists bleeding. On the other hand, when the ink used has a relatively low viscosity and is prone to bleeding, the channel grooves preferably terminate in the middle of the ink hole rather than penetrate to the back hole.

The "writing ball" is a metal sphere made of cemented carbide stainless steel or the like, and inserted into the ball house. The ink reaching the ball house adheres to a surface of the writing ball and is transferred to a writing surface.

The "ball seat" is a recessed curved surface formed by pressing the writing ball inserted into the ball house rearwardly by a so-called "beating process" to transfer the curved surface of the writing ball on the bottom surface of the ball house.

The "bent portion" is a structure in which an edge opening of the second tapered surface after the writing ball is inserted into the ball house is bent inwardly to reduce an inner diameter, thereby preventing the writing ball from falling. The boundary between the bent portion and the second tapered surface is referred to as the "second shoulder portion."

In addition to the above-described structure, providing that there is a tangent line between the writing ball and the first shoulder portion in the virtual section (which is referred to as the "virtual tangent line"), the second shoulder portion is located inside the virtual tangent line, that is, on the side of the ballpoint pen tip. In other words, the second shoulder portion does not protrude outwardly from the virtual tangent line or is not located on the virtual tangent line. Further, a distance between the virtual tangent line and the second shoulder portion is preferably 20 μm or less.

The ballpoint pen tip according to the present invention is particularly suitable for an ink refill using ink with a shear-thinning property, for example, water-based gel ink having a viscosity of 100 to 3,000 mPa·sec at a shearing rate of 3.84 $sec^{-1}$ at 25° C. Then, when being used for such an ink refill, the ballpoint pen tip preferably includes a spring for constantly pressing the writing ball against an inner periphery of the bent portion. Specifically, the spring is located in the back hole and its front end portion is formed as a pressing rod that presses the writing ball toward the front end. Further, when the ink has a relatively high viscosity and resists bleeding like oil-based ink, such a spring is unnecessary. When such a ballpoint pen tip is used, a bleeding prevention effect is reduced at the viscosity less than 100 mPa·sec under the above-described condition. The viscosity more than 3,000 mPa·sec under the same condition may cause line splitting or increase ink dripping, thereby reducing writing performance.

With the above-described configuration, in an ink refill including an ink-containing tube that contains ink (for example, the water-based gel ink as described above or other ink), to which the ballpoint pen tip according to the present invention is mounted, the second shoulder portion does not touch a writing surface even if the first shoulder portion touches the writing surface when a writing angle is shallow during writing. Specifically, the front end portion from the second shoulder portion (that is, the entire bent portion) does not touch the writing surface, thereby preventing deformation caused by touching. Moreover, bleeding caused by the deformation of the bent portion is prevented, and poor writing feeling such as entangled feeling caused by the deformation of the bent portion can be prevented.

With the ballpoint pen tip and the ink refill using the ballpoint pen tip according to the present invention, the shoulder of the bent portion does not touch the paper surface during writing, thereby preventing bleeding caused by deformation of the inner periphery of the bent portion.

BEST MODE FOR CARRYING OUT THE INVENTION

(1) First Embodiment

Figure 1:
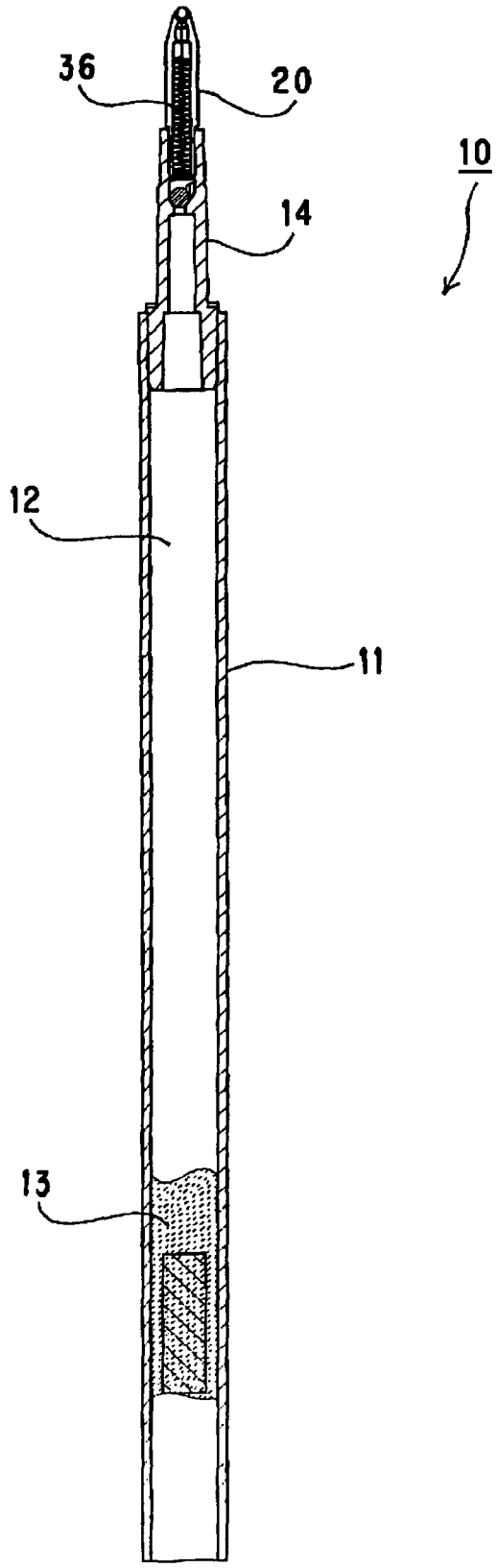
FIG. 1 is a partially sectional front view of an ink refill according to a first embodiment of the present invention.

An ink refill 10 according to a first embodiment of the present invention comprises, as shown in a partially sectional front view in FIG. 1, a ballpoint pen tip 20, a joint 14, and an ink-containing tube 11.

The ink-containing tube 11 is a polypropylene tube, and filled with water-based gel ink 12 having a viscosity of 100 to 3,000 mPa·sec at a shearing rate of 3.84 $sec^{-1}$ at 25° C.

Figure 2:
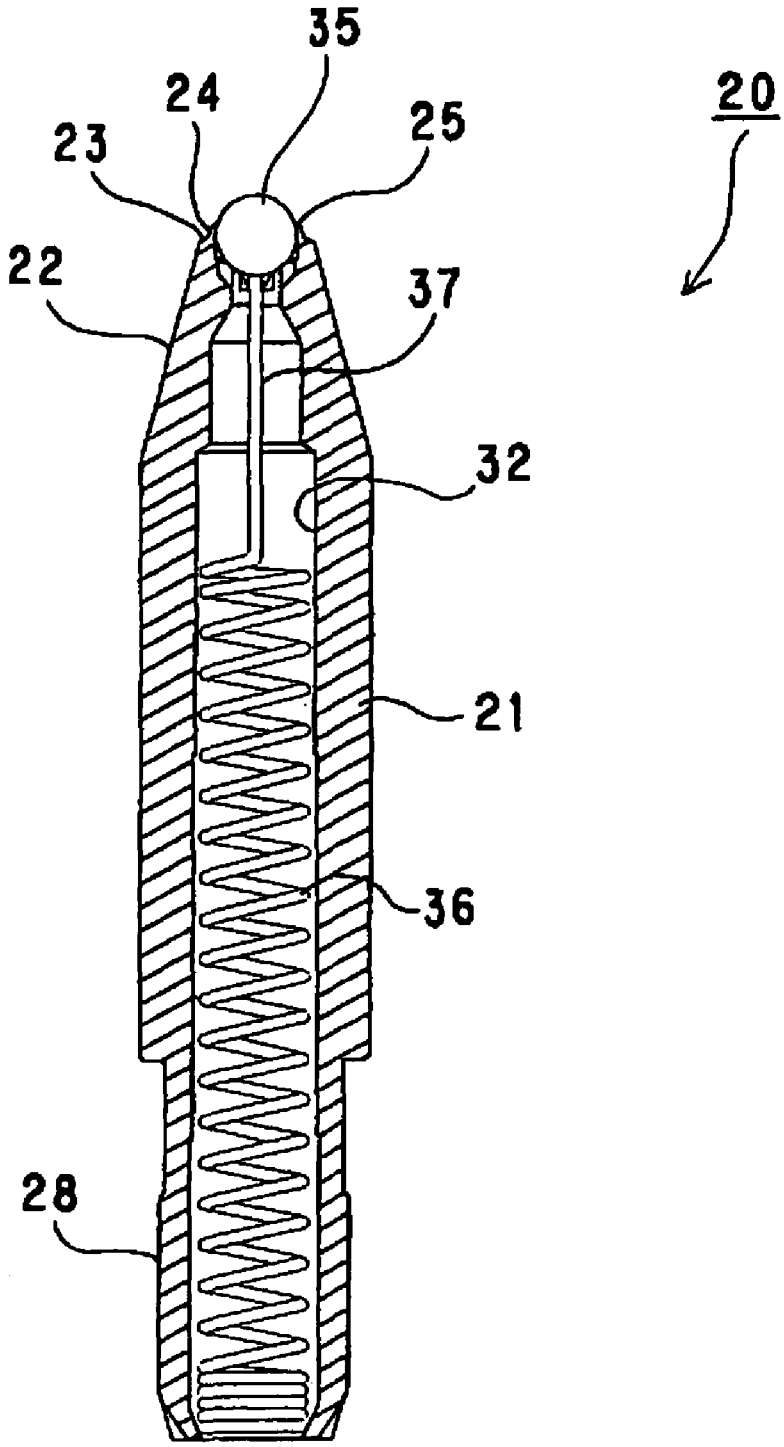
FIG. 2 is a partially sectional front view of a ballpoint pen tip according to the first embodiment of the present invention.

FIG. 2 is a partially sectional front view of the ballpoint pen tip 20. A front end portion of a holder 21 formed of a cylindrical stainless steel material is cut into a substantially conical shape and tapered to form a first tapered surface 22, and a connecting surface 23 having an inwardly decreasing diameter, and a second tapered surface 24 protruding from the connecting surface 23 and having a further decreasing diameter are formed. On the other hand, a rear end portion is formed as an inserted portion 28 having a decreasing outer diameter. Furthermore, a front end of a writing ball 35 held inside the first tapered surface 22, the connecting surface 23, and the second tapered surface 24 is exposed from a front edge of the second tapered surface 24, and an opening edge of the second tapered surface 24 is pressed inwardly and deformed to have a decreasing diameter to form a bent portion 25. Into the back hole 32 is inserted a spring 36 formed of a coil spring. A front end of the spring 36 is formed as a pressing rod 37 extending straight toward the front end.

Figure 3:
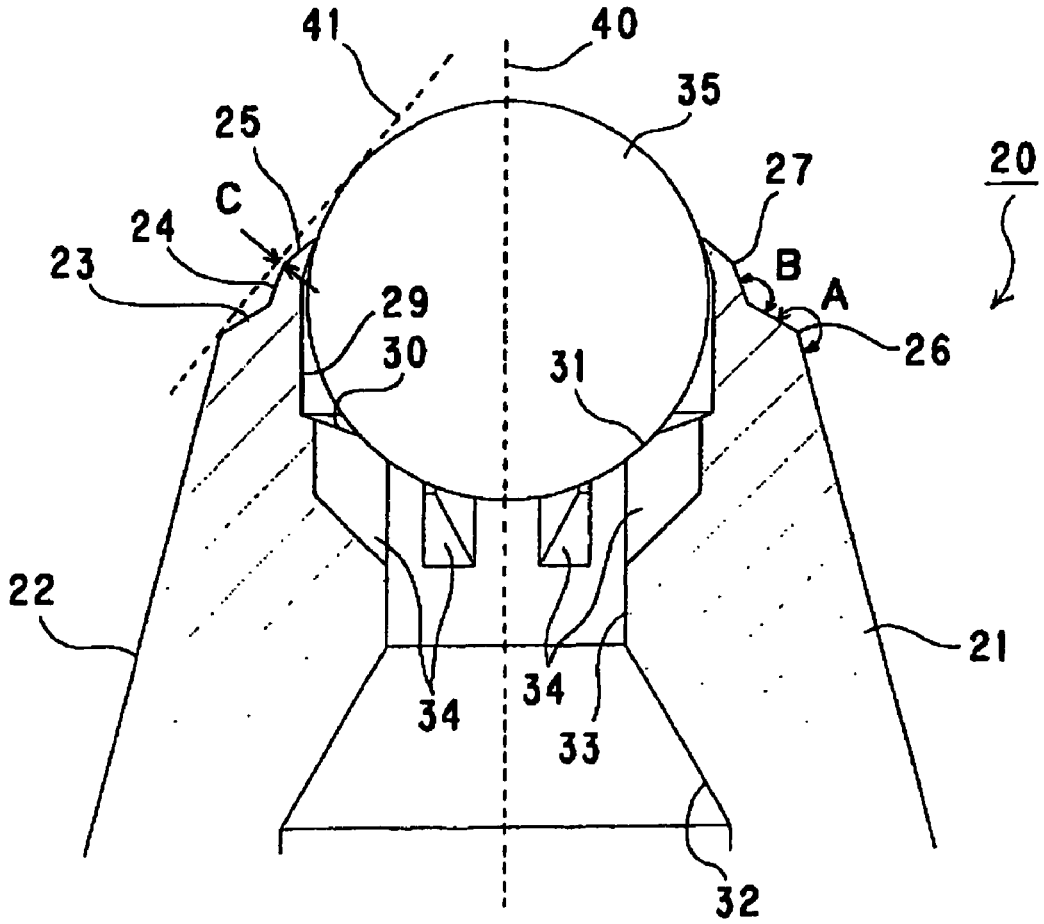
FIG. 3 is a partially sectional front view of an essential portion of the ballpoint pen tip according to the first embodiment of the present invention (with a spring omitted).

A virtual section of a front end portion of the ink refill 10 including the holder axis 40 is shown in a partially sectional front view of an essential portion in FIG. 3 (with the spring 36 omitted). In this section, an angle A formed between the first tapered surface 22 and the connecting surface 23 and located outside is larger than 180°. An angle B formed between the connecting surface 23 and the second tapered surface 24 and located outside is smaller than 180°. The connecting surface 23 and the second tapered surface 24 are formed by cutting a front end portion of the first tapered surface 22.

In FIG. 3, the boundary between the first tapered surface 22 and the connecting surface 23 is referred to as a first shoulder portion 26, and the boundary between the second tapered surface 24 and the bent portion 25 is referred to as a second shoulder portion 27. The second shoulder portion 27 is located inside by a distance C from a virtual tangent line 41 between the first shoulder portion 26 and the writing ball 35. The distance C is set to 20 μm or less.

Figure 4:
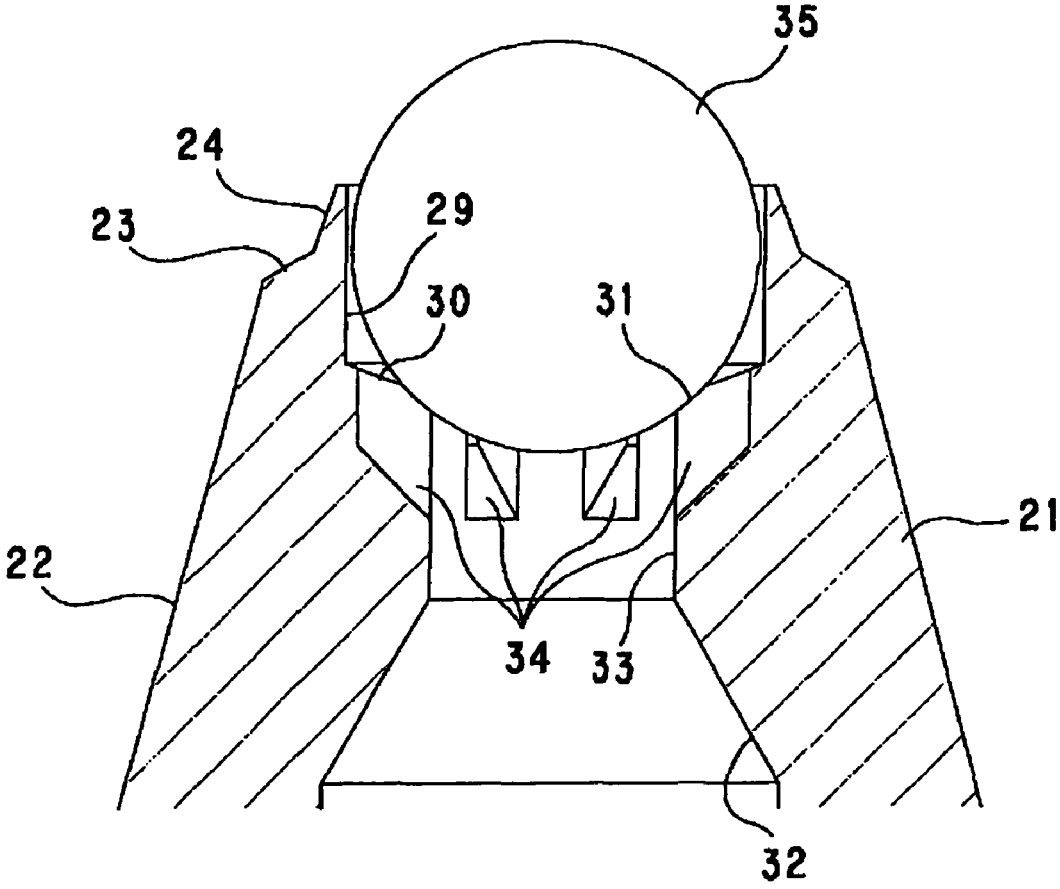
FIG. 4 is a partially sectional front view of an essential portion showing a production process of the ballpoint pen tip according to the first embodiment of the present invention.

With reference to FIGS. 2 and 3, and a partially sectional front view in FIG. 4 showing a state before a bending process, a production process of the ballpoint pen tip 20 according to the present invention will be described.

First, the front end of the cylindrical stainless steel material is cut to be tapered to form the first tapered surface 22 (see FIG. 2). Then, a cutting tool having a cutting edge angle equal to the angle B is used to cut the front end portion of the first tapered surface 22 to form the connecting surface 23 and the second tapered surface 24 (see FIG. 4). On the other hand, the rear end portion of the holder 21 is cut so as to have a decreasing outer diameter to form the inserted portion 28 (see FIG. 2).

Then, a back hole 32 is drilled from the rear end of the holder 21 to a midway of the first tapered surface 22 (see FIGS. 2 and 4). Next, an ink hole 33 is penetrated from the front end of the holder 21 to the back hole 32, and then a ball house 29 is cut and formed also from the front end by a drill having a slightly larger diameter than an outer diameter of the writing ball 35 (see FIG. 4). The ball house 29 has a depth beyond the second tapered surface 24 and the connecting surface 23 and reaches the front end portion of the first tapered surface 22. Then, six channel grooves 34 radially provided at regular intervals around the ink hole 33 are formed from the bottom surface 30 of the ball house 29 using a channel tool (see FIG. 4). The channel grooves 34 do not reach the back hole 32 but terminate at the midway of the ink hole 33.

Then, the writing ball 35 made of cemented carbide is inserted into the ball house 29, and then beaten from the front end direction. Thus, a part of a spherical surface of the writing ball 35 is transferred to the bottom surface 30 of the ball house 29 by press deformation. This forms a ball seat 31 (see FIG. 4).

Then, a front end of the second tapered surface 24 is press-deformed inwardly by a bending tool to form the bent portion 25 (see FIG. 3).

Finally, the spring 36 is inserted from the rear end of the holder 21, and with the pressing rod 37 located at the front end of the spring 36 abutted against a rear end of the writing ball 35, the spring 36 is maintained in a contracted state, and the rear end of the holder 21 is bent to secure the spring 36 (see FIG. 2).

The completed ballpoint pen tip 20 is mounted to a front end of the ink-containing tube 11 via the joint 14 with the inserted portion 28 inserted into the joint 14 (see FIG. 1). The water-based gel ink 12 is poured into the ink refill 10, and a grease-like ink follower 13 is further poured into the rear end for preventing ink-leakage from the rear end. Thus, the ink refill 10 is completed (see FIG. 1).

As shown in FIG. 3, the second shoulder portion 27 is located inside by the distance C from the virtual tangent line 41 between the first shoulder portion 26 and the writing ball 35. Assuming that the virtual tangent line 41 is a writing surface, the second shoulder portion 27 does not touch the writing surface even if a writing angle is so shallow that the first shoulder portion 26 touches the writing surface.

(2) Second Embodiment

Figure 5:
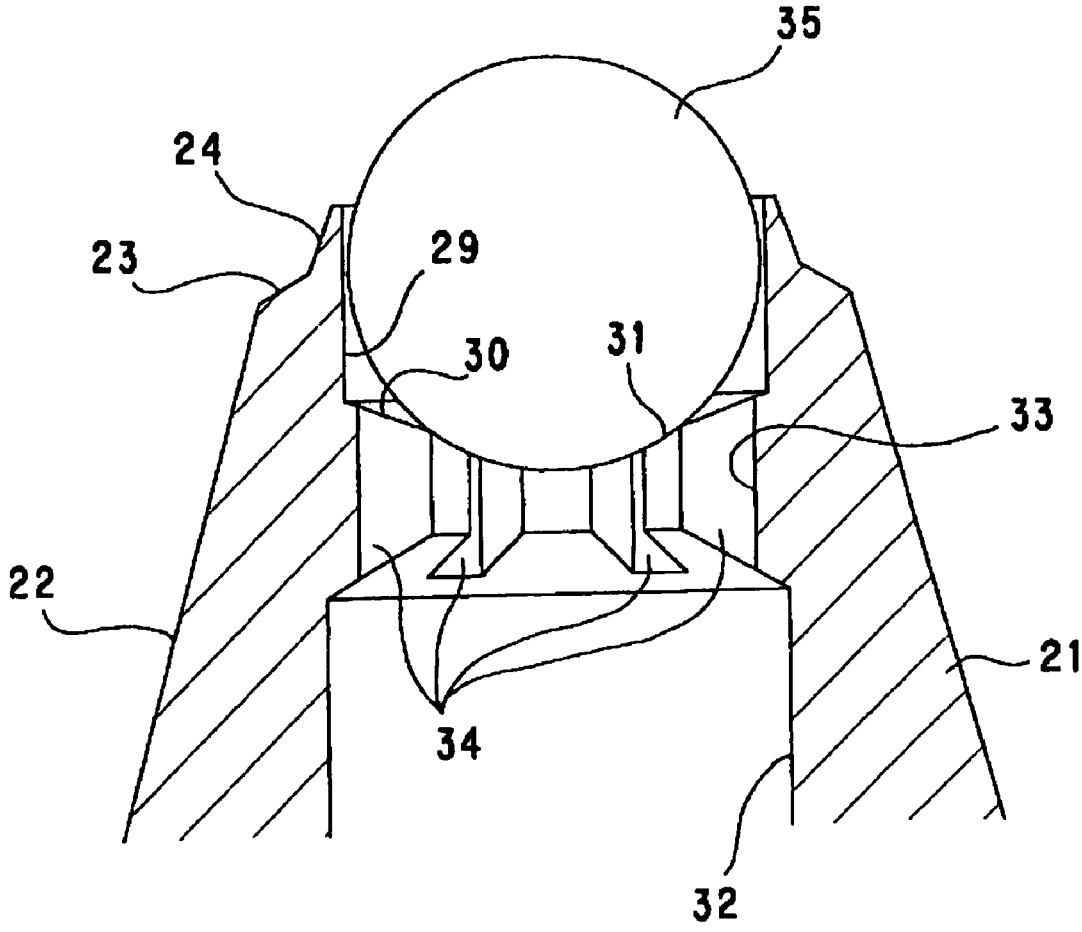
FIG. 5 is a partially sectional front view of an essential portion showing a production process of a ballpoint pen tip according to a second embodiment of the present invention.
Figure 6:
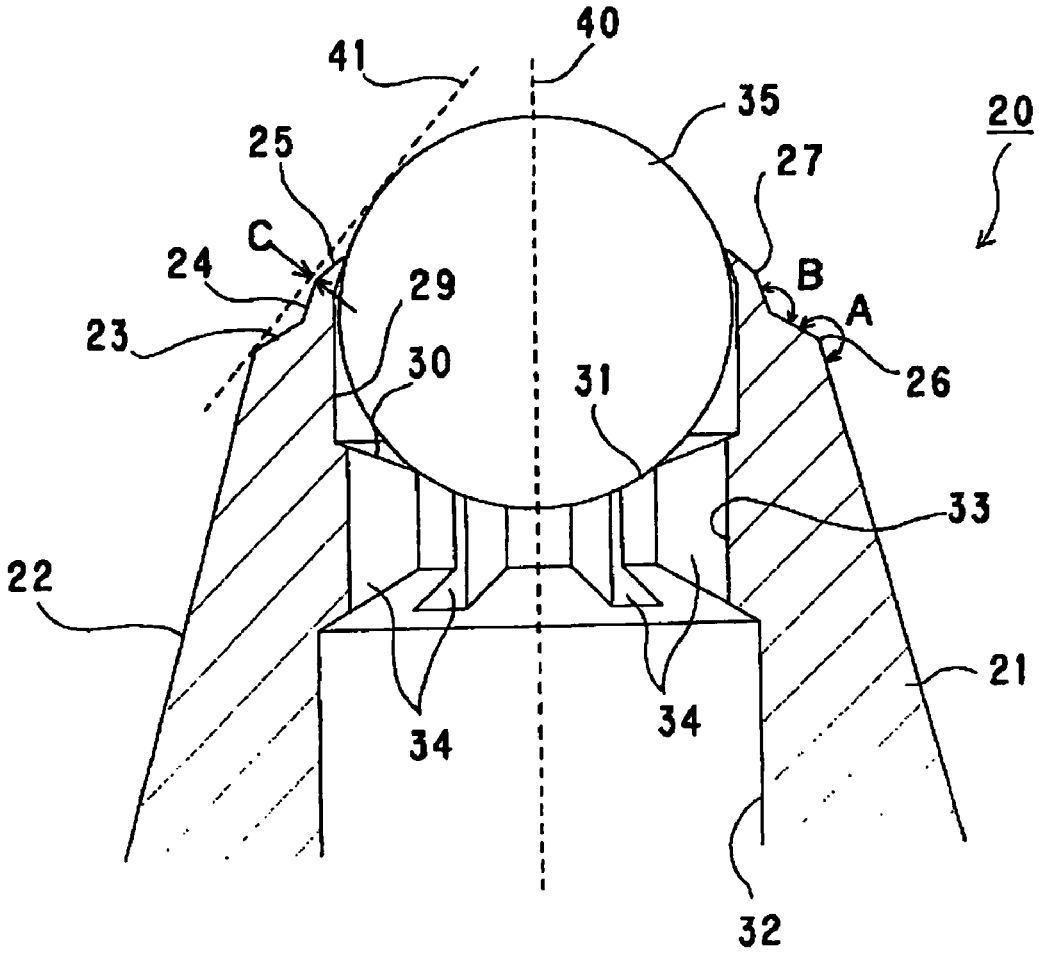
FIG. 6 is a partially sectional front view of an essential portion of the ballpoint pen tip according to the second embodiment of the present invention.

FIGS. 5 and 6 are partial sectional views of a front end portion of a ballpoint pen tip 20 according to a second embodiment of the present invention.

The largest difference between this embodiment and the first embodiment is that the spring 36 is not used, and that the channel grooves 34 reach the back hole 32 (see FIGS. 5 and 6). Such a form is more suitable in use of ink having a relatively high viscosity such as oil-based ink.

A production process of the ballpoint pen tip 20 according to the embodiment is basically the same as in the first embodiment, and will be now briefly described.

A cylindrical material is cut to have a first tapered surface 22, a connecting surface 23, and a second tapered surface 24, drilled to have a back hole 32, penetrated to have an ink hole 33, and cut to have a ball house 29 as in the first embodiment. Next, channel grooves 34 are formed as in the first embodiment except that the grooves reach the back hole 32. Then, a writing ball 35 is inserted and a ball seat 31 is formed by being beaten as in the first embodiment, and this state is shown in FIG. 5.

Then, a bent portion 25 is also formed as in the first embodiment, and this state is shown in FIG. 6. The angles A and B and the distance C are the same as in the first embodiment.

Figure 7:
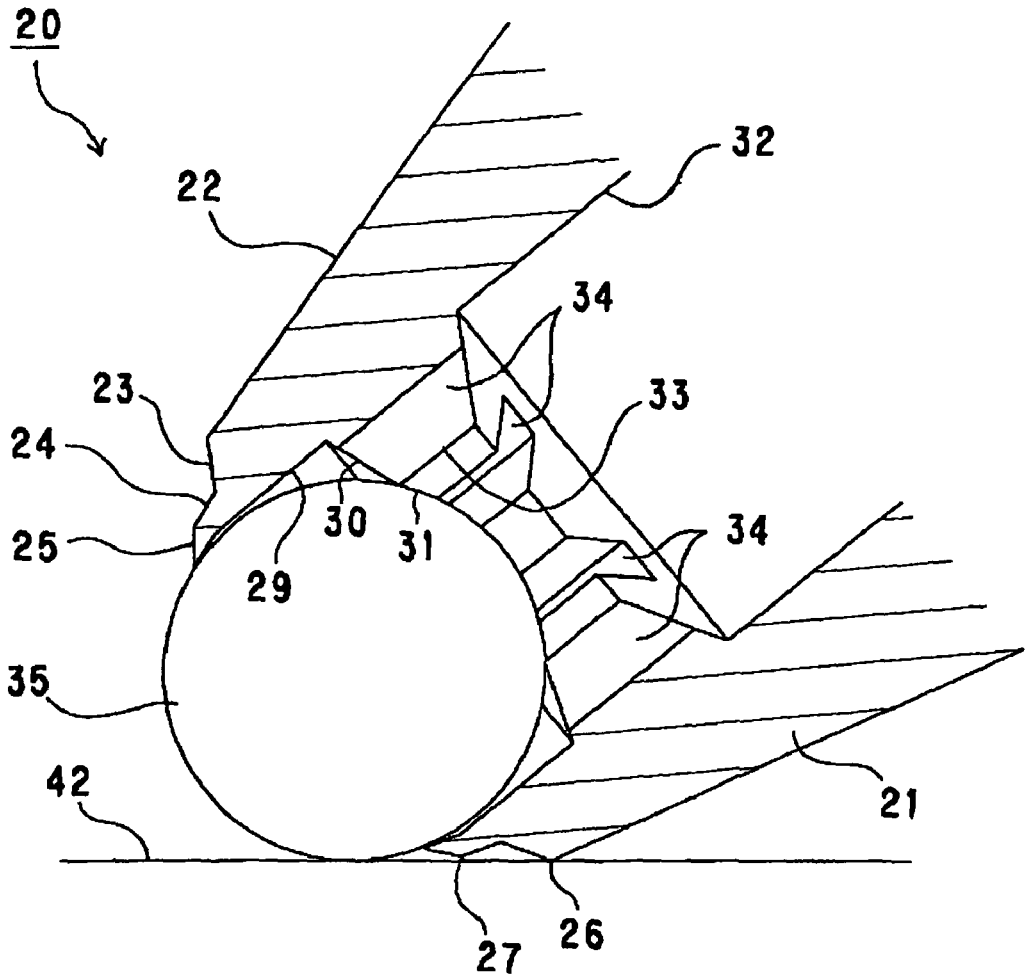
FIG. 7 is a partially sectional front view of an essential portion showing a writing state with the ballpoint pen tip according to the second embodiment of the present invention.

FIG. 7 shows a writing state with the ballpoint pen tip 20 according to the present embodiment. The second shoulder portion 27 is located inside by the distance C from the virtual tangent line 41 between the first shoulder portion 26 and the writing ball 35 (see FIG. 6), and the second shoulder portion 27 does not touch a writing surface 42 even if a writing angle is so shallow that the first shoulder portion 26 touches the writing surface 42. Thus, the bent portion 25 does not touch the writing surface 42 during writing.

EXAMPLES

Now, examples of the present invention will be described in comparison with comparative examples.

(1) Examples and Comparative Examples

A ballpoint pen tip of each of examples and comparative examples was formed to have a writing ball diameter of 0.7 mm and to be of a type containing a spring as in the first embodiment. The ballpoint pen tip was mounted to a front end of an ink-containing tube via a joint to form an ink refill as in the first embodiment. Further, the ink-containing tube, the joint, and the ink and the ink follower contained were those used in a commercially available ink refill (UMR-87, ink color: black, MITSUBISHI PENCIL). This was mounted to a shaft of a commercially available retractable ballpoint pen (UMN-152-07, MITSUBISHI PENCIL) and the following tests were conducted. The weight of the shaft was 14±2 g.

A distance C, that is, a distance between a tangent line between the writing ball and the first shoulder portion, and the second shoulder portion in each of the examples and the comparative examples were as shown in Table 1.

TABLE 1

| Example/ Comparative example | Distance C (μm) |
|---|---|
| Comparative example 1 | −5 |
| Comparative example 2 | 0 |
| Example 1 | 5 |
| Example 2 | 10 |
| Example 3 | 15 |
| Example 4 | 20 |
| Example 5 | 25 |

The distance C of the negative value in the table means that the second shoulder portion protruded outwardly from the tangent line between the writing ball and the first shoulder portion. The distance C of zero means that the second shoulder portion was located on the tangent line between the writing ball and the first shoulder portion.

(2) Test method

In determination criteria described below, "A" is the best, followed by "B" and "C," and "D" the worst.

(2-1) Bleeding Test

Under the environment at the temperature of 23±2° C. and the relative humidity of 65±10%, with a writing tip protruded from a front end of the shaft to which the ink refill in each of the example and comparative example is mounted, the writing tip was caused to fall downwardly from the height of 1 m onto a receiving plate inclined 50° with respect to a horizontal surface. Then, five circles having a diameter of 20 to 25 cm were written freehand, and the ballpoint pen was then immediately secured downwardly and left for 60 minutes. Then, the size of an ink droplet stuck onto the front end of the ballpoint pen tip was measured. The determination criteria were as shown in Table 2 below.

TABLE 2

| Size of ink droplet | Evaluation |
|---|---|
| 0 mm (no ink droplet) | A |
| More than 0 mm and 1 mm or less | B |
| More than 1 mm and 2 mm or less | C |
| More than 2 mm | D |

(2-2) Catching Feeling

A monitor, who freely wrote using the ballpoint pen to which the ink refill in each of the examples and comparative examples was mounted maintaining a writing angle of about 45°, made sensory evaluation of catching feeling shown in Table 3 below.

TABLE 3

| Catching feeling | Evaluation |
|---|---|
| None | A |
| Slight | B |
| Moderate | C |
| Considerable | D |

(3) Result

A test result for the ink refill according to each of the examples and comparative examples was as shown in Table 4 below.

TABLE 4

| Example/ Comparative example | Bleeding test | Catching feeling |
|---|---|---|
| Comparative example 1 | D | A |
| Comparative example 2 | C | A |
| Example 1 | B | A |
| Example 2 | A | A |
| Example 3 | A | B |
| Example 4 | A | C |
| Example 5 | A | D |

According to the above, in Comparative example 1 in which the second shoulder portion protruded outwardly from the tangent line between the writing ball and the first shoulder portion, and in Comparative example 2 in which the second shoulder portion was located on the tangent line, the bleeding test showed undesirable results as compared with the examples in which the second shoulder portion was located inside the tangent line. Therefore, this revealed that the second shoulder portion was favorably located inside the tangent line in terms of preventing bleeding.

On the other hand, in terms of catching feeling, evaluation became worse according to the increase of the distance C. Since the second shoulder portion was located more inwardly from the tangent line between the writing ball and the first shoulder portion according to the increase of the distance C, the second shoulder portion was less likely to touch the paper surface while the first shoulder portion more likely to touch the paper surface, resulting in that the catching feeling became worse. This revealed that the distance C is preferably 20 μm or less in terms of catching feeling.

The invention claimed is:

1. A ballpoint pen tip comprising:

a holder;

a first tapered surface formed by tapering an outer periphery at a front end of the holder;

a connecting surface being a surface formed at a front end side of the first tapered surface, and making an outside angle larger than 180° with respect to the first tapered surface in a virtual section including an axis of the holder;

a second tapered surface being a tapered surface formed at a front end side of the connecting surface, and making an outside angle smaller than 180° with respect to the connecting surface in the virtual section;

a ball house formed as an inner space of the first tapered surface, the connecting surface, and the second tapered surface;

a back hole formed as an inner space extending from a rear end of the holder to a vicinity of the ball house;

an ink hole being a hole with a circular section penetrating between the ball house and the back hole;

channel grooves being a plurality of grooves provided at regular intervals around the ink hole so as to communicate between a bottom surface of the ball house and the ink hole;

a writing ball located in the ball house;

a ball seat formed in the bottom surface of the ball house by transferring a part of a curved surface of the writing ball; and a bent portion being formed by inwardly bending a front end portion of the second tapered surface;

a boundary between the first tapered surface and the connecting surface being referred to as a first shoulder portion;

a boundary between the second tapered surface and the bent portion being referred to as a second shoulder portion; and the second shoulder portion being located inside an virtual tangent line between the first shoulder portion and the writing ball in the virtual section.

2. The ballpoint pen tip according to claim 1, wherein a distance between the virtual tangent line and the second shoulder portion is 20 mm or less.

3. The ballpoint pen tip according to claim 2, further comprising a spring inserted into the back hole, the front end portion of the spring being formed as a pressing rod pressing the writing ball toward the front end.

4. The ballpoint pen tip according to claim 1, further comprising a spring inserted into the back hole, the front end portion of the spring being formed as a pressing rod pressing the writing ball toward the front end.

5. An ink refill comprising:

a ballpoint pen tip comprising:

a holder;

a first tapered surface formed by tapering an outer periphery at a front end of the holder;

a connecting surface being a surface formed at a front end side of the first tapered surface, and making an outside angle larger than 180° with respect to the first tapered surface in a virtual section including an axis of the holder;

a second tapered surface being a tapered surface formed at a front end side of the connecting surface, and making an outside angle smaller than 180° with respect to the connecting surface in the virtual section;

a ball house formed as an inner space of the first tapered surface, the connecting surface, and the second tapered surface;

a back hole formed as an inner space extending from a rear end of the holder to a vicinity of the ball house;

an ink hole being a hole with a circular section penetrating between the ball house and the back hole;

channel grooves being a plurality of grooves provided at regular intervals around the ink hole so as to communicate between a bottom surface of the ball house and the ink hole;

a writing ball located in the ball house;

a ball seat formed in the bottom surface of the ball house by transferring a part of a curved surface of the writing ball; and a bent portion being formed by inwardly bending a front end portion of the second tapered surface; and an ink-containing tube to which the ballpoint pen tip is mounted at a front end and in which ink is contained;

a boundary between the first tapered surface and the connecting surface being referred to as a first shoulder portion;

a boundary between the second tapered surface and the bent portion being referred to as a second shoulder portion; and the second shoulder portion being located inside an virtual tangent line between the first shoulder portion and the writing ball in the virtual section.

6. The ink refill according to claim 5, wherein the ink is water-based gel ink having a viscosity of 100 to 3,000 mPax-sec at a shearing rate of 3.84 sec-1 at 25° C., and the ballpoint pen tip further comprises a spring located in the back hole, its front end portion being formed as a pressing rod pressing the writing ball toward the front end.

* * * * *